US012559216B2

(12) United States Patent
Pela

(10) Patent No.: US 12,559,216 B2
(45) Date of Patent: Feb. 24, 2026

(54) OUTBOARD ENGINE MOUNT BRACKET

(71) Applicant: Xtreme Hummer Performance LLC, Jupiter, FL (US)

(72) Inventor: Adam Christopher Pela, Jupiter, FL (US)

(73) Assignee: XTREME HUMMER PERFORMANCE LLC, Jupiter, FL (US)

( * ) Notice: Subject to any disclaimer, the term of this patent is extended or adjusted under 35 U.S.C. 154(b) by 30 days.

(21) Appl. No.: 18/489,232

(22) Filed: Oct. 18, 2023

(65) Prior Publication Data

US 2025/0128802 A1 Apr. 24, 2025

(51) Int. Cl.
*B63H 20/06* (2006.01)

(52) U.S. Cl.
CPC ..... *B63H 20/06* (2013.01)

(58) Field of Classification Search
CPC ..... B63H 20/06; B63H 20/02; B63H 20/007; F16M 7/00
USPC .... 248/640–643, 674, 346.01, 346.02, 346.5
See application file for complete search history.

(56) References Cited

U.S. PATENT DOCUMENTS

| | | | | | |
|---|---|---|---|---|---|
| 3,106,375 | A * | 10/1963 | Donaldson | B63H 20/10 | 248/300 |
| 3,245,641 | A * | 4/1966 | Hart | B63H 20/06 | 248/641 |
| 4,448,387 | A * | 5/1984 | Gilbreath | B63H 20/06 | 248/642 |
| 4,482,330 | A * | 11/1984 | Cook | B63H 20/106 | 440/61 R |
| 4,545,559 | A * | 10/1985 | Gilbreath | B63H 20/06 | 248/642 |
| 2007/0001491 | A1* | 1/2007 | Marotta | B63B 29/04 | 297/216.1 |
| 2017/0174304 | A1* | 6/2017 | Abbott | B63H 20/06 | |
| 2020/0130797 | A1* | 4/2020 | Mizutani | B63H 20/06 | |

* cited by examiner

*Primary Examiner* — Christopher Garft
(74) *Attorney, Agent, or Firm* — BUCHANAN INGERSOLL & ROONEY PC

(57) ABSTRACT

Embodiments relate to an outboard engine mount bracket that may be fastened to a transom and mount an outboard engine without requiring modification of the transom. The bracket comprises a first plate, a second plate, and at least one riser positioned between and secured to the first plate and the second plate. The bracket offsets the engine from the rear of the vessel while also providing built-in lift to accommodate larger engines. The bracket allows for adjustments by providing a number of different bracket fastening positions and engine mounting positions.

17 Claims, 3 Drawing Sheets

OUTBOARD ENGINE MOUNT BRACKET

FIELD OF THE INVENTION

Embodiments relate to an outboard engine mount bracket generally and methods of use thereof. More particularly, embodiments relate to an outboard engine mount bracket that may be installed in existing mounting holes of a transom while providing an offset and vertically adjustable outboard engine mounting location and methods of use thereof.

BACKGROUND OF THE INVENTION

Today's outboard engines are continually increasing in horsepower and size. These new engines not only provide significantly more power, but they also have larger cowlings and larger gearcases to accommodate improved performance and efficiency. Accordingly, these engines further require an increased number of fasteners to mount onto the transom. These issues are magnified as the height of outboard engines often need to be adjusted as well. Benefits of adjusting the prop-shaft height with respect to the hull have been proven for many years, as significant gains in speed and efficiency can be realized with even minor adjustments. However, boat hull manufacturers have failed to redesign their hulls to accommodate such needs. Users often need to drill new mounting holes while concurrently filling and painting pre-existing, nonfunctional holes. Even so, many retrofit vessels are challenged by the ability to mount the engine high enough while also maintaining a low transom freeboard.

Ultimately, there is a clear need for a high strength, adjustable engine mount bracket that can offset the engine from the transom while also raising the engine. There is also a need for an engine mount bracket that can accommodate and be installed in existing mounting holes of a transom.

SUMMARY OF INVENTION

Embodiments relate to an outboard engine mount bracket that can be used to mount an outboard engine to a boat hull without requiring modification of the transom, as the bracket accommodates any number of different mounting hole locations on a transom. Moreover, the bracket offsets the engine from the rear of the vessel while also providing built-in lift to accommodate larger engines. The bracket allows for adjustments by providing a number of different engine mounting positions.

In an exemplary embodiment, an outboard engine mount bracket comprises a first plate comprising a plurality of assembly apertures and a plurality of mounting apertures, wherein the mounting apertures are configured to mount an outboard engine on the bracket; a second plate comprising a plurality of assembly apertures and a plurality of fastening apertures, wherein the fastening apertures are configured to fasten the bracket to a transom; and at least one riser comprising a first lateral face including a plurality of assembly bolt receiving apertures and a second lateral face including a plurality of assembly bolt receiving apertures, wherein at least one at least one of the plurality of assembly bolt receiving apertures of the first lateral face align with at least one of the plurality of assembly apertures of the first plate, and at least one of the plurality of assembly bolt receiving apertures of the second lateral face align with at least one of the plurality of assembly apertures of the second plate.

In some embodiments, each of the plurality of assembly bolt receiving apertures of the first lateral face align with an assembly aperture of the first plate, and each of the plurality of assembly bolt receiving apertures of the second lateral face align with an assembly aperture of the second plate.

In some embodiments, the bracket further comprises a plurality of assembly bolts configured to secure the first plate to the first lateral face of the at least one riser and the second plate to the second lateral face of the at least one riser.

In some embodiments, the first plate is higher than the second plate in an assembled state.

In some embodiments, the first plate is at least 2.5 inches higher than the second plate in an assembled state.

In some embodiments, the first plate further comprises at least one slotted aperture.

In some embodiments, the first plate further comprises a first slotted aperture and a second slotted aperture, wherein the positions of the first and second slotted apertures are mirrored about a center line of the bracket.

In some embodiments, the plurality of mounting apertures includes a first set of mounting apertures and a second set of mounting apertures, and wherein the positions of the first and second sets of mounting apertures are mirrored about a center line of the bracket.

In some embodiments, the plurality of mounting apertures and the at least one slotted aperture are configured to mount an outboard engine to the bracket.

In some embodiments, the second plate further comprises at least one slotted aperture.

In some embodiments, the second plate further comprises a first slotted aperture and a second slotted aperture, wherein the positions of the first and second slotted apertures are mirrored about a center line of the bracket.

In some embodiments, the plurality of fastening apertures includes a first set of fastening apertures and a second set of fastening apertures, and wherein the positions of the first and second sets of fastening mounting are mirrored about a center line of the bracket.

In some embodiments, the plurality of fastening apertures and the at least one slotted aperture are configured to fastening the bracket to a transom.

In some embodiments, the first plate is offset from the transom by at least 4.5 inches in a fastened stated.

In some embodiments, the bracket further comprises a plurality of fastening bolts configured to fasten the bracket to a transom.

In some embodiments, the bracket further comprises a plurality of mounting bolts configured to mount an outboard engine to the bracket.

In some embodiments, the first plate comprises a first central bore and the second plate comprises a second central bore.

In some embodiments, the first central bore and the second central bore at least partially align in an assembled state.

In some embodiments, the first plate, the second plate, and the at least one riser comprises aluminum.

In some embodiments, the first plate, the second plate, and the at least one riser are hard coat anodized.

BRIEF DESCRIPTION OF THE DRAWINGS

The above and other objects, aspects, features, advantages, and possible applications of the present innovation will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Figure 1:
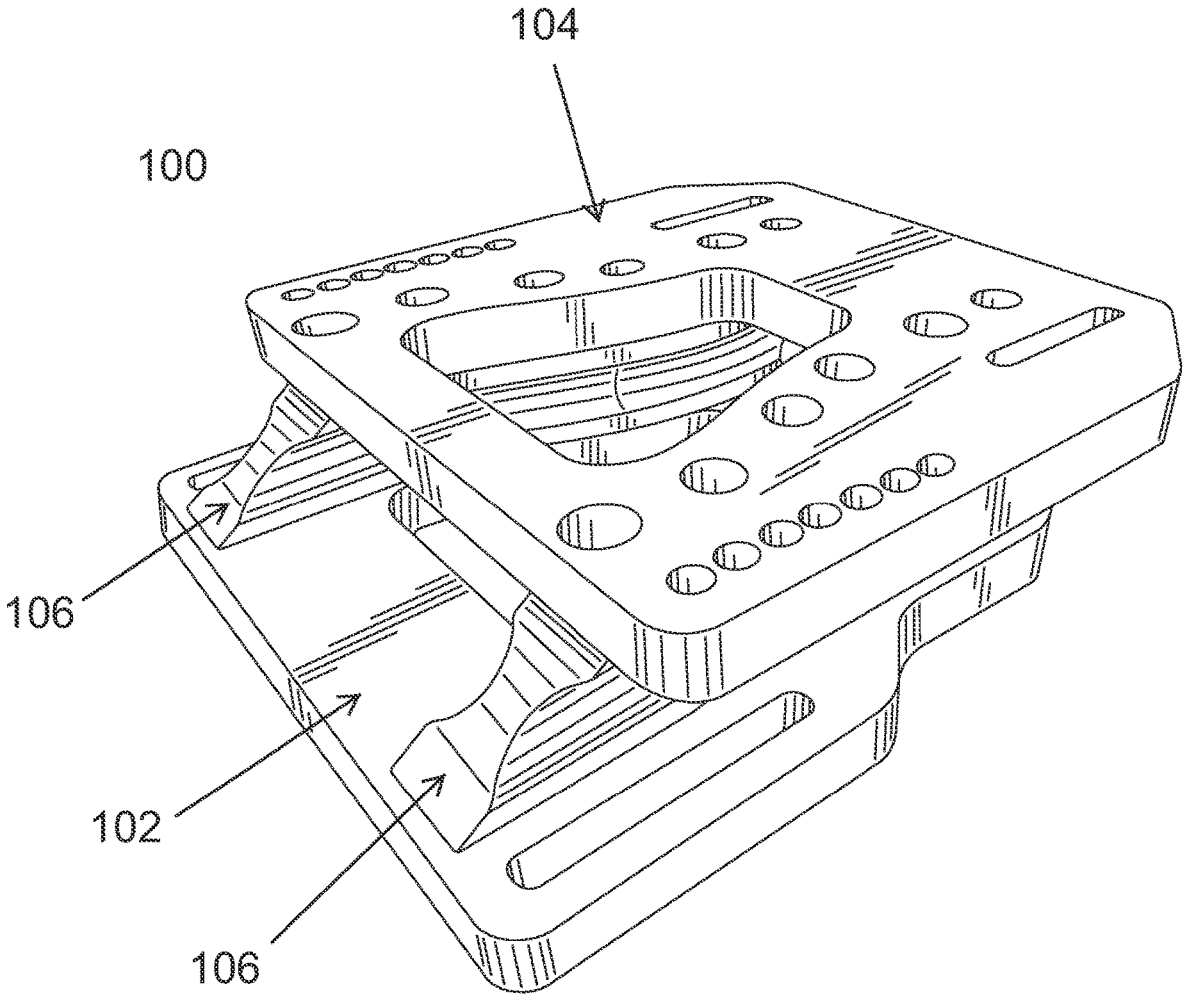
FIG. 1 is a rear perspective view of an embodiment of a bracket.
Figure 2:
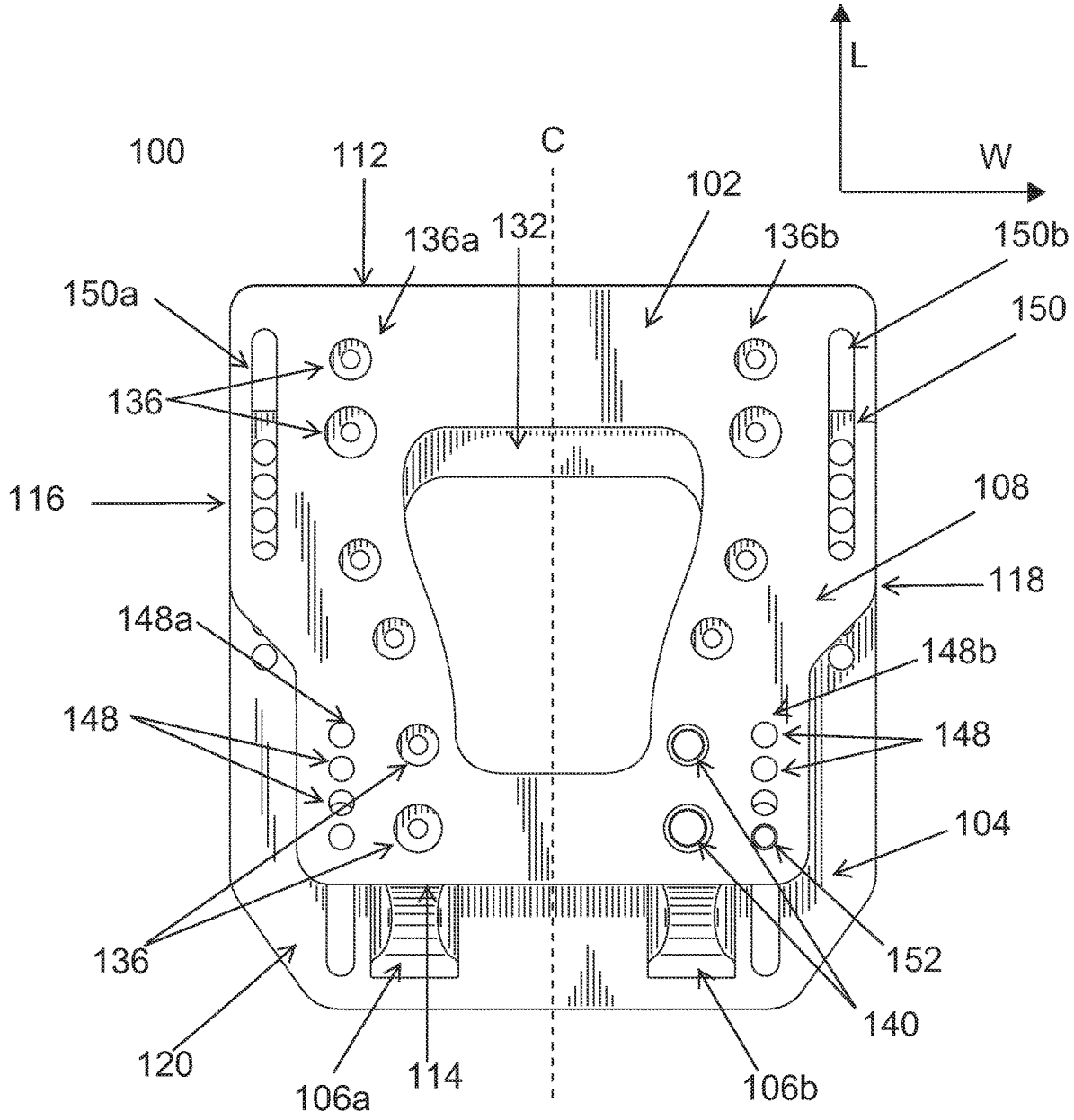
FIG. 2 is a front view of an embodiment of a bracket.
Figure 3:
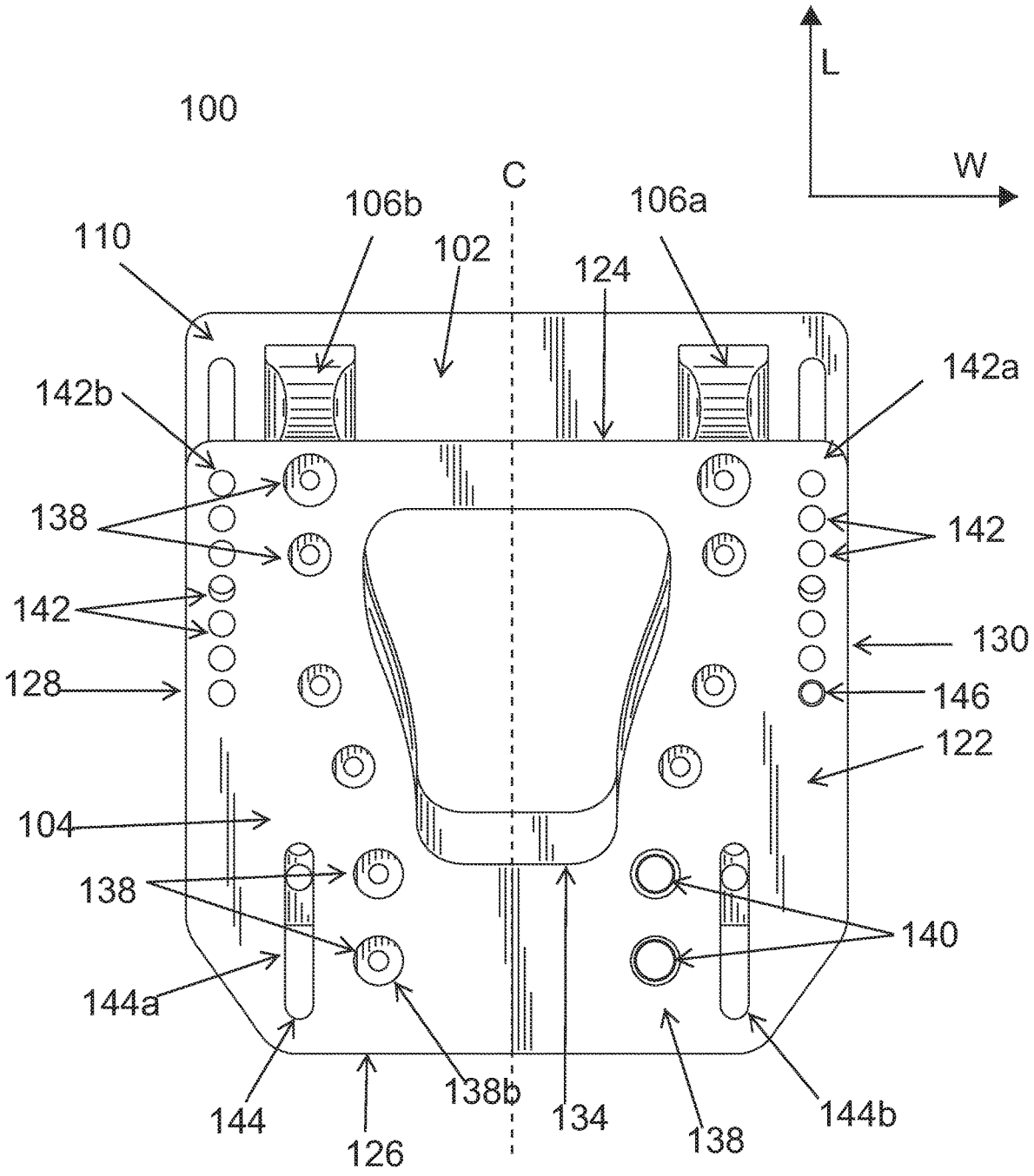
FIG. 3 is a rear view of an embodiment of a bracket.

Embodiments relate to a bracket 100 that may be fastened to a transom and mount an outboard engine. As seen in FIGS. 1-3, the bracket 100 comprises a first plate 102, a second plate 104, and at least one riser 106 positioned between and secured to the first plate 102 and the second plate 104.

The first plate 102 has a front face 108 and a back face 110. In an assembled state (e.g., the bracket 100 is assembled or in a condition to be assembled), the front face 108 is exposed to a user, and the back face 110 abuts the at least one riser 106. The profile of the first plate 102 can be any shape, e.g., rectangular, square, pentagonal, hexagonal, octagonal, etc. It is contemplated that the first plate 102 has at least four edges, including a top edge 112, a bottom edge 114, and side edges 116, 118. The side edges 116, 118 may be defined as the entire periphery between the top edge 112 and the bottom edge 114. The front face 108 and/or back face 110 can be flat or substantially flat. It is contemplated that the size and shape of the first plate 102 may be designed such that the back face 110 can contact the at least one riser 106 in a flat or substantially flat manner.

It is contemplated that the first plate 102 can be made of a rigid material, such as metal, metal alloy, etc. In a preferred embodiment, the first plate 102 comprises aluminum. It is further contemplated that the first plate 102 may be hard coat anodized.

The second plate 104 has a front face 120 and a back face 122. In an assembled state, the front face 120 abuts the at least one riser 106 and the back face 122 abuts a boat hull. The profile of the second plate 104 can be any shape, e.g., rectangular, square, pentagonal, hexagonal, octagonal, etc. It is contemplated that the second plate 104 has at least four edges, including a top edge 124, a bottom edge 126, and side edges 128, 130. The side edges 128, 130 may be defined as the entire periphery between the top edge 124 and the bottom edge 126. The front face 120 and/or back face 122 can be flat or substantially flat. It is contemplated that the size and shape of the second plate 104 may be designed such that the front face 120 can contact the at least one riser 106 in a flat or substantially flat manner, and the back face 122 can contact the hull in a flat or substantially flat manner.

It is contemplated that the second plate 104 can be made of a rigid material, such as metal, metal alloy, etc. In a preferred embodiment, the second plate 104 comprises aluminum. It is further contemplated that the second plate 104 may be hard coat anodized.

The profile of the at least one riser 106 can be any shape, e.g., rectangular, square, pentagonal, hexagonal, octagonal, etc. It is contemplated that the at least one riser 106 is elongated and extends in an L direction. It is contemplated that the at least one riser 106 may be an oblique shape such that its lateral faces are not perpendicular to its top and bottom surfaces. The at least one riser 106 has a first lateral face and a second lateral face (not shown). The first lateral face abuts the back face 110 of the first plate 102 and the second lateral face abuts the front face 120 of the second plate 104. It is contemplated that the first and second lateral faces of the at least one riser 106 may be designed such that the back face 110 of the first plate 102 and the front face 120 of the second plate 104 contact the lateral faces in a flat or substantially flat manner.

It is contemplated that the at least one riser 106 can be made of a rigid material, such as metal, metal alloy, etc. In a preferred embodiment, the risers 106 comprise aluminum. It is further contemplated that the risers 106 may be hard coat anodized.

It is contemplated that the first plate 102, the second plate 104, and the at least one riser 106 comprise or consist of the same material(s). Alternatively, it is contemplated that the first plate 102, the second plate 104, and the at least one riser 106 comprise or consist of different material(s).

In an exemplary embodiment, the bracket 100 may comprise a first riser **106*a* and a second riser 106*b*. It is contemplated that in such embodiment, the first riser 106*a* may be positioned on one side of a center line C of the bracket 100 and the second riser 106*b* may be positioned on the other side of the center line C. In a preferred embodiment, the positions of the first riser 106*a* and second riser 106*b*** are mirrored (e.g., symmetrical) about the center line C.

In an exemplary embodiment, the first plate 102 may comprise a first central bore 132. Similarly, the second plate 104 may comprise a second central bore 134. It is contemplated that the first central bore 132 and the second central bore 134 may not be perfectly centered on the first plate 102 and second plate 104, respectively, but may simply provide holes that include or nearly include a central region of the plates. The first central bore 132 and the second central bore 134 may be any shape, though it is contemplated that the bores may be similar (or the same) shapes such that the bores may at least partially (or completely) align in an assembled state. The first central bore 132 and the second central bore 134 are advantageous in that they provide material savings and increase ease of handling and/or hauling of the bracket 100.

Assembly of Bracket

The first plate 102 comprises a plurality of assembly apertures 136. The assembly apertures 136 are holes formed in the body of the first plate 102 and extend from the front face 108, through the body of the first plate 102, and to the back face 110. As will be explained herein, the assembly apertures 136 are configured to secure the first plate 102 to the at least one riser 106. The first plate 102 can have any number of assembly apertures 136. It is contemplated that the assembly apertures 136 may have an internal threaded portion or may be internally smooth. It is further contemplated that the assembly apertures 136 may be counterbores, such that bolts inserted into the assembly apertures 136 may sit flush with or below the front face 108 of the first plate 102.

The at least one riser 106 comprises a plurality of assembly bolt receiving apertures 154 in its first lateral face. The assembly bolt receiving apertures 154 are holes formed in the first lateral face of the riser that extend into the body of the riser 106. It is contemplated that the assembly bolt receiving apertures 154 may have an internal threaded portion or may be internally smooth. In operation, the first plate 102 may be secured to the at least one riser 106 by aligning at least one assembly aperture 136 with an assembly bolt receiving aperture 154, and by placing at least one assembly bolt 140 through the assembly aperture 136 and into the assembly bolt receiving aperture 154. It is contemplated that any number of or each assembly aperture 136 of the first plate 102 may be aligned with an assembly bolt receiving aperture 154 of the at least one riser 106, and an assembly bolt 140 can be placed through any number of or each assembly aperture 136 and into the aligned assembly bolt receiving aperture 154.

Generally, being aligned properly means that an aperture overlies and is coaxial with another aperture.

In an exemplary embodiment, the first plate 102 may comprise a first set 136*a* of assembly apertures 136 that are vertically distributed (e.g., extending in or substantially in an L direction) on one side of a center line C. The first set 136*a* of assembly apertures 136 may extend from at or near the top edge 112 to at or near the bottom edge 114. The first plate 102 may further comprise a second set 136*b* of assembly apertures 136 that are vertically distributed (e.g., extending in or substantially in an L direction) on the other side of the center line C. The second set 136*b* of assembly apertures 136 may extend from at or near the top edge 112 to at or near the bottom edge 114. In a preferred embodiment, the positions of the first and second set of assembly apertures 136 are mirrored (e.g., symmetrical) about the center line C.

In such embodiment, a plurality of assembly bolt receiving apertures 154 may similarly be vertically distributed (e.g., extending in or substantially in an L direction) in a first lateral face of a first riser 106*a*, such that each assembly bolt receiving aperture 154 aligns with a respective aperture of the first set 136*a* of assembly apertures 136, and vice versa. Additionally, a plurality of assembly bolt receiving apertures 154 may similarly be vertically distributed (e.g., extending in or substantially in an L direction) in a first lateral face of a second riser 106*b*, such that each assembly bolt receiving aperture 154 aligns with a respective aperture of the second set 136*b* of assembly apertures 136, and vice versa.

In such embodiment, the first plate 102 may be secured to the first riser 106*a* by aligning at least one assembly aperture 136 of the first set 136*a* with an assembly bolt receiving aperture 154 of the first riser 106*a*, and by placing at least one assembly bolt 140 through the assembly aperture 136 and into the aligned assembly bolt receiving aperture 154. The first plate 102 may similarly be secured to the second riser 106*b* by aligning at least one assembly aperture 136 of the second set 136*b* with an assembly bolt receiving aperture 154 of the second riser 106*b*, and by placing at least one assembly bolt 140 through the assembly aperture 136 and into aligned the assembly bolt receiving aperture 154.

It is contemplated that any number of or each assembly aperture 136 of the first set 136*a* may be aligned with an assembly bolt receiving aperture 154 of the first riser 106*a*, and an assembly bolt 140 can be placed through any number of or each assembly aperture 136 of the first set 136*a* and into the respective assembly bolt receiving aperture 154 of the first riser 106*a*. It is similarly contemplated that any number of or each assembly aperture 136 of the second set 136*b* may be aligned with an assembly bolt receiving aperture 154 of the second riser 106*b*, and an assembly bolt 140 can be placed through any number of or each assembly aperture 136 of the second set 136*b* and into the respective assembly bolt receiving aperture 154 of the second riser 106*b*.

The second plate 104 comprises a plurality of assembly apertures 138. The assembly apertures 138 are holes formed in the body of the second plate 104 and extend from the back face 122, through the body of the second plate 104, and to the front face 120. As will be explained herein, the assembly apertures 138 are configured to secure the second plate 104 to the at least one riser 106. The second plate 104 can have any number of assembly apertures 138. It is contemplated that the assembly apertures 138 may have an internal threaded portion or may be internally smooth. It is further contemplated that the assembly apertures 138 may be counterbores, such that bolts inserted into the assembly apertures 138 may sit flush with or below the back face 122 of the second plate 104.

The at least one riser 106 comprises a plurality of assembly bolt receiving apertures 156 in its second lateral face. The assembly bolt receiving apertures 156 are holes formed in the second lateral face of the riser that extend into the body of the riser 106. It is contemplated that the assembly bolt receiving apertures 156 may have an internal threaded portion or may be internally smooth. In operation, the second plate 104 may be secured to the at least one riser 106 by aligning at least one assembly aperture 138 with an assembly bolt receiving aperture 156, and by placing at least one assembly bolt 140 through the assembly aperture 138 and into the assembly bolt receiving aperture 156. It is contemplated that any number of or each assembly aperture 138 of the second plate 104 may be aligned with an assembly bolt receiving aperture 156 of the at least one riser 106, and an assembly bolt 140 can be placed through any number of or each assembly aperture 138 and into the aligned assembly bolt receiving aperture 156.

In an exemplary embodiment, the second plate 104 may comprise a first set 138*a* of assembly apertures 138 that are vertically distributed (e.g., extending in or substantially in an L direction) on one side of a center line C. The first set 138*a* of assembly apertures 138 may extend from at or near the top edge 124 to at or near the bottom edge 126. The second plate 104 may further comprise a second set 138*b* of assembly apertures 138 that are vertically distributed (e.g., extending in or substantially in an L direction) on the other side of the center line C. The second set 138*b* of assembly apertures 138 may extend from at or near the top edge 124 to at or near the bottom edge 126. In a preferred embodiment, the positions of the first and second set of assembly apertures 138 are mirrored (e.g., symmetrical) about the center line C.

In such embodiment, a plurality of assembly bolt receiving apertures 156 may similarly be vertically distributed (e.g., extending in or substantially in an L direction) in a second lateral face of a first riser 106*a*, such that each assembly bolt receiving aperture 156 aligns with a respective aperture of the first set 138*a* of assembly apertures 138, and vice versa. Additionally, a plurality of assembly bolt receiving apertures 156 may similarly be vertically distributed (e.g., extending in or substantially in an L direction) in a second lateral face of a second riser 106*b*, such that each assembly bolt receiving aperture 156 aligns with a respective aperture of the second set 138*b* of assembly apertures 138, and vice versa.

In such embodiment, the second plate 104 may be secured to the first riser 106*a* by aligning at least one assembly aperture 138 of the first set 138*a* with an assembly bolt receiving aperture 156 of the first riser 106*a*, and by placing at least one assembly bolt 140 through the assembly aperture 138 and into the aligned assembly bolt receiving aperture 156. The second plate 104 may similarly be secured to the second riser 106*b* by aligning at least one assembly aperture 138 of the second set 138*b* with an assembly bolt receiving aperture 156 of the second riser 106*b*, and by placing at least one assembly bolt 140 through the assembly aperture 138 and into the aligned assembly bolt receiving aperture 156.

It is contemplated that any number of or each assembly aperture 138 of the first set 138*a* may be aligned with an assembly bolt receiving aperture 156 of the first riser 106*a*, and an assembly bolt 140 can be placed through any number of or each assembly aperture 138 of the first set 138*a* and into the assembly bolt receiving aperture 156 of the first riser 106*a*. It is similarly contemplated that any number of or each assembly aperture 138 of the second set 138*b* may be aligned with an assembly bolt receiving aperture 156 of the second riser 106*b*, and an assembly bolt 140 can be placed through any number of or each assembly aperture 138 of the second set 138*b* and into the assembly bolt receiving aperture 156 of the second riser 106*b*.

The assembly bolts 140 can be any type and have any head style (e.g., flat, oval, hex, truss, button, etc.). In some embodiments, the assembly bolts 140 can have an external threaded portion to complement the internal threads of the assembly apertures 136, assembly apertures 138, and assembly bolt receiving apertures 156.

One or more washers may be interposed between the head of the assembly bolt 140 and any abutting structure (e.g., the first plate 102 or the second plate 104).

It is contemplated that the assembly bolt receiving apertures 156 of the first and second lateral faces of the at least one riser 106 may be configured such that, in an assembled state, the first plate 102 will be positioned higher (e.g., in the L direction) than the second plate 104.

Fastening to Transom

The second plate 104 comprises a plurality of fastening apertures 142. The fastening apertures 142 are holes formed in the body of the second plate 104 and extend from the front face 120, through the body of the second plate 104, and to the back face 122. As will be explained herein, the fastening apertures 142 are configured to work together with slotted apertures 144 to secure the bracket 100 to the transom. The second plate 104 can have any number of fastening apertures 142. In an exemplary embodiment, a first set 142*a* of fastening apertures 142 are vertically distributed (e.g., extending in or substantially in the L direction) on one side of the center line C, and a second set 142*b* of fastening apertures 142 are vertically distributed (e.g., extending in or substantially in the L direction) on the other side of the center line C. It is contemplated that the first and second sets of fastening apertures 142 are positioned at or near the top edge 124 and side edges 128, 130. In a preferred embodiment, the positions of the first and second sets of fastening apertures 142 are mirrored (e.g., symmetrical) about the center line C. In a preferred embodiment, the fastening apertures 142 may be positioned further from center line C than the assembly apertures 138 in a W direction.

The fastening apertures 142 may have an internal threaded portion or may be internally smooth.

In a fastened state (e.g., the bracket 100 is in a condition to be fastened to the transom), at least one fastening aperture 142 may be aligned with a transom hole, and a fastening bolt 146 may be placed through the fastening aperture 142 and into the transom hole. A transom hole may be defined as a hole drilled into a transom to assist in directly or indirectly mounting an outboard engine to the transom. In an exemplary embodiment, at least one fastening aperture 142 of the first set 142*a* may be aligned with a first transom hole and at least one fastening aperture 142 of the second set 142*b* may be aligned with a second transom hole, such that a fastening bolt 146 may be placed through both the fastening aperture 142 of the first set 142*a* and the fastening aperture 142 of the second set 142*b*.

It is contemplated that any number of or each fastening aperture 142 of the first set 142*a* may be aligned with a respective transom hole, and a fastening bolt 146 can be placed through any number of or each fastening aperture 142 of the first set 142*a* and into the respective transom hole. It is similarly contemplated that any number of or each fastening aperture 142 of the second set 142*b* may be aligned with a respective transom hole, and a fastening bolt 146 can be placed through any number of or each fastening aperture 142 of the second set 142*b* and into the respective transom hole.

The second plate 104 further comprises a plurality of slotted apertures 144. The slotted apertures 144 are holes with an elongated shape formed in the body of the second plate 104 and extend from the front face 120, through the body of the second plate 104, and to the back face 122. The second plate 104 can have any number of slotted apertures 144. In exemplary embodiments, the second plate 104 has at least two slotted apertures 144. In an exemplary embodiment, a first slotted aperture 144*a* extends in or substantially in an L direction on one side of a center line C, while a second slotted aperture 144*a* extends in or substantially in the L direction on the other side of the center line C. It is contemplated that the first and second slotted apertures 144*a*, 144*b* are positioned at or near the bottom edge 126 and the side edges 128, 130. In a preferred embodiment, the positions of the first and second slotted apertures 144*a*, 144*b* are mirrored (e.g., symmetrical) about the center line C.

It is contemplated that the slotted apertures 144 may be positioned below the fastening apertures 142 in the L direction. It is further contemplated that the slotted apertures 144 may be positioned closer to the center line C than the fastening apertures 142 in a W direction. In a preferred embodiment, the slotted apertures 144 may be positioned further from center line C than the assembly apertures 138 in a W direction.

In a fastened state, a slotted aperture 144 may be aligned with at least one transom hole, and a fastening bolt 146 may be placed through the slotted aperture 144 and at least one the transom hole. In an exemplary embodiment, the first slotted aperture 144*a* may be aligned with a first transom hole and the second slotted aperture 144*b* may be aligned with a second transom hole, such that a fastening bolt 146 may be placed through both the first slotted aperture 144*a* and the second slotted aperture 144*b*.

In an exemplary embodiment, the fastening apertures 142 are configured to work together with slotted apertures 144 to secure the bracket 100 to the transom. For example, (i) at least one fastening aperture 142 of the first set 142*a* may be aligned with a first transom hole, (ii) at least one fastening aperture 142 of the second set 142*b* may be aligned with a second transom hole, (iii) the first slotted aperture 144*a* may be aligned with a third transom hole, and (iv) the second slotted aperture 144*b* may be aligned with a fourth transom hole.

The fastening bolts 146 can be any type and have any head style (e.g., flat, oval, hex, truss, button, etc.). In some embodiments, the fastening bolts 146 can have an external threaded portion to complement the internal threads of the fastening apertures 142.

One or more washers may be interposed between the head of the fastening bolt 146 and any abutting structure (e.g., the second plate 104).

It is contemplated that by providing a plurality of fastening apertures 142 with various positions, and by providing at least one slotted aperture 144 with an elongated shape, a user is able to adjust the position of the bracket 100 on the transom in a quick and easy manner. Moreover, a user is able to accommodate various different positions of pre-existing transom holes such that a user will not need to drill new holes in the transom and fill/paint old transom holes to accommodate the bracket 100. The bracket 100 is thus a universal bracket configured to accommodate all transoms and transom hole designs.

Mounting Outboard Engine

The first plate 102 comprises a plurality of mounting apertures 148. The mounting apertures 148 are holes formed in the body of the front plate 102 and extend from the front face 108, through the body of the front plate 102, and to the back face 110. As will be explained herein, the mounting apertures 148 are configured to work together with slotted apertures 150 to secure an outboard engine to the front plate 102. The front plate 102 can have any number of mounting apertures 148. In an exemplary embodiment, a first set 148*a* of mounting apertures 148 are vertically distributed (e.g., extending in or substantially in the L direction) on one side of the center line C, and a second set 148*b* of mounting apertures 148 are vertically distributed (e.g., extending in or substantially in the L direction) on the other of the center line C. It is contemplated that the first and second sets of mounting apertures 148 are positioned at or near the bottom edge 114 and side edges 116, 118. In a preferred embodiment, the positions of the first and second sets of mounting apertures 148 are mirrored about the center line C. In a preferred embodiment, the mounting apertures 142 may be positioned further from center line C than the assembly apertures 136 in a W direction.

The mounting apertures 148 may have an internal threaded portion or may be internally smooth.

In a mounted state (e.g., the outboard engine is in a position to be mounted to the bracket 100), at least one mounting aperture 148 may be aligned with a mounting site of an outboard engine, and a mounting bolt 152 may be placed through the engine's mounting site and mounting aperture 148. In an exemplary embodiment, at least one mounting aperture 148 of the first set 148*a* may be aligned with a first engine mounting site and at least one mounting aperture 148 of the second set 148*b* may be aligned with a second engine mounting site, such that a mounting bolt 152 may be placed through both the engine's first mounting site and the engine's mounting second site.

It is contemplated that any number of or each mounting aperture 148 of the first set 148*a* may be aligned with a respective engine mounting site, and a mounting bolt 152 can be placed through any number of or each mounting aperture 148 of the first set 148*a* and the respective engine mounting site. It is similarly contemplated that any number of or each mounting aperture 148 of the second set 148*b* may be aligned with a respective engine mounting site, and a mounting bolt 152 can be placed through any number of or each mounting aperture 148 of the second set 148*b* and the respective engine mounting site.

The first plate 102 further comprises a plurality of slotted apertures 150. The slotted apertures 150 are holes with an elongated shape formed in the body of the front plate 102 and extend from the front face 108, through the body of the front plate 102, and to the back face 110. The first plate 102 can have any number of slotted apertures 150. In exemplary embodiments, the first plate 102 has at least two slotted apertures 150. In an exemplary embodiment, a first slotted aperture 150*a* extends in or substantially in an L direction on one side of a center line C, while a second slotted aperture 150*b* extends in or substantially in the L direction on the other side of the center line C. It is contemplated that the first and second slotted apertures 150*a*, 150*b* are positioned at or near the top edge 112 and the side edges 116, 118. In a preferred embodiment, the positions of the first and second mounted apertures 150*a*, 150*b* are mirrored (e.g., symmetrical) about the center line C.

It is contemplated that the slotted apertures 150 may be positioned above the mounting apertures 148 in the L direction. It is further contemplated that the slotted apertures 150 may be positioned further away from center line C than the mounting apertures 148 in a W direction. In a preferred embodiment, the slotted apertures 150 may be positioned further from center line C than the assembly apertures 136 in a W direction.

In a mounted state, at least one slotted aperture 150 may be aligned with an engine mounting site, and a mounting bolt 152 may be placed through the engine mounting site and the slotted aperture 150. In an exemplary embodiment, the first slotted aperture 150*a* may be aligned with a first engine mounting site and the second slotted aperture 150*b* may be aligned with a second engine mounting site, such that a mounting bolt 152 may be placed through both the first engine mounting site and the second engine mounting site.

In an exemplary embodiment, the mounting apertures 148 are configured to work together with slotted apertures 150 to secure the outboard engine to the bracket 100. For example, (i) at least one mounting aperture 148 of the first set 148*a* may be aligned with a first engine mounting site, (ii) at least one mounting aperture 148 of the second set 148*b* may be aligned with a second engine mounting site, (iii) the first slotted aperture 150*a* may be aligned with a third engine mounting site, and (iv) the second slotted aperture 150*b* may be aligned with a fourth engine mounting site.

The mounting bolts 152 can be any type and have any head style (e.g., flat, oval, hex, truss, button, etc.). In some embodiments, the mounting bolts 152 can have an external threaded portion to complement the internal threads of the mounting apertures 148.

One or more washers may be interposed between the head of the mounting bolt 152 and any abutting structure (e.g., the first plate 102).

It is contemplated that by providing a plurality of mounting apertures 148 with various positions, and by providing at least one slotted aperture 150 with an elongated shape, a user is able to adjust the position of the outboard engine on the bracket 100 in a quick and easy manner.

It is contemplated that the bracket 100 as configured offsets the engine from the boat hull of the vessel. In exemplary embodiments, the bracket 100 may create at least 3 inches, preferably at least 4 inches, and most preferably at least 4.5 inches of offset from the transom to create more room at the rear of the vessel and to allow the bracket to provide built-in lift. For example, in an assembled state, the first plate 102 will be positioned higher (e.g., in the L direction) than the second plate 104. In exemplary embodiments, the bracket 100 may provide at least 1 inch, preferably at least 2 inches, and most preferably at least 2.5 inches of lift to accommodate large engines.

It is contemplated that the bracket 100 may be used with any transom of any boat hull.

It is contemplated that the bracket 100 may be used to mount outboard engines of over 500 horsepower.

It is contemplated that the bracket 100 has a similar or substantially footprint as an original outboard engine mount, such that the bracket 100 is not wider or taller than the original outboard engine mount. It is further contemplated that the bracket 100 does not extend vertically or horizontally outside of the engine mount footprint.

In operation, it is contemplated that one bracket 100 may be fastened to the transom. The bracket 100 may be centrally located along the width of the transom. In alternative embodiments, more than one bracket 100 may be fastened to the transom. The brackets 100 may be equally spaced apart.

It should be understood that modifications to the embodiments disclosed herein can be made to meet a particular set of design criteria. For instance, the number or configuration of components or parameters may be used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features or parts of other embodiments. The elements and acts of the various embodiments described herein can therefore be combined to provide further embodiments.

It is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of the device and methods of making and using the same have been discussed and illustrated herein, it is to be distinctly understood that the invention is not limited thereto but may be otherwise variously embodied and practiced within the scope of the following claims.

What is claimed is:

1. An outboard engine mount bracket comprising:

a first plate comprising a plurality of assembly apertures and a plurality of mounting apertures, wherein the mounting apertures are configured to mount an outboard engine on the bracket;

a second plate comprising a plurality of assembly apertures and a plurality of fastening apertures, wherein the fastening apertures are configured to fasten the bracket to a transom; and at least one riser positioned between and abutting both the first plate and the second plate, wherein the at least one riser comprises a first lateral face including a plurality of assembly bolt receiving apertures and a second lateral face opposite the first lateral face and including a plurality of assembly bolt receiving apertures, wherein at least one at least one of the plurality of assembly bolt receiving apertures of the first lateral face align with at least one of the plurality of assembly apertures of the first plate, and at least one of the plurality of assembly bolt receiving apertures of the second lateral face align with at least one of the plurality of assembly apertures of the second plate, and wherein the bracket is a static structure such that the bracket maintains the outboard engine in a singular position and cannot move out of said singular position so long as the outboard engine remains mounted to the bracket.

2. The bracket of claim 1, wherein each of the plurality of assembly bolt receiving apertures of the first lateral face align with an assembly aperture of the first plate, and each of the plurality of assembly bolt receiving apertures of the second lateral face align with an assembly aperture of the second plate.

3. The bracket of claim 2, further comprising:

a plurality of assembly bolts configured to secure the first plate to the first lateral face of the at least one riser and the second plate to the second lateral face of the at least one riser.

4. The bracket of claim 1, further comprising:

a plurality of assembly bolts configured to secure the first plate to the first lateral face of the at least one riser and the second plate to the second lateral face of the at least one riser such that the first plate is higher than the second plate in a length direction.

5. The bracket of claim 1, wherein the first plate further comprises a first slotted aperture and a second slotted aperture, wherein the positions of the first and second slotted apertures are mirrored about a center line of the bracket, wherein the plurality of mounting apertures includes a first set of mounting apertures and a second set of mounting apertures, wherein the positions of the first and second sets of mounting apertures are mirrored about a center line of the bracket, and wherein the first and second sets of mounting apertures and the first and second slotted apertures are configured to mount the outboard engine to the bracket.

6. The bracket of claim 1, wherein the second plate further comprises at least one slotted aperture.

7. The bracket of claim 1, wherein the second plate further comprises a first slotted aperture and a second slotted aperture, wherein the positions of the first and second slotted apertures are mirrored about a center line of the bracket.

8. The bracket of claim 1, wherein the plurality of fastening apertures includes a first set of fastening apertures and a second set of fastening apertures, and wherein the positions of the first and second sets of fastening mounting are mirrored about a center line of the bracket.

9. The bracket of claim 6, wherein the plurality of fastening apertures and the at least one slotted aperture are configured to fasten the bracket to a transom.

10. The bracket of claim 1, further comprising:

a plurality of fastening bolts configured to fasten the bracket to a transom.

11. The bracket of claim 1, further comprising:

a plurality of mounting bolts configured to mount an outboard engine to the bracket.

12. The bracket of claim 1, wherein the first plate comprises a first central bore and the second plate comprises a second central bore.

13. The bracket of claim 12, wherein the first central bore and the second central bore at least partially align in an assembled state.

14. The bracket of claim 1, wherein the first plate, the second plate, and the at least one riser comprises aluminum.

15. The bracket of claim 14, wherein the first plate, the second plate, and the at least one riser are hard coat anodized.

16. The bracket of claim 1, wherein the at least one riser has an oblique shape such that the first lateral face and the second lateral face of the at least one riser are not perpendicular to a top surface and a bottom surface of the at least one riser, wherein the oblique shape positions the first plate higher than the second plate in a length direction.

17. The bracket of claim 1, wherein the at least one riser comprises a first riser and a second riser:

the first riser positioned between and abutting both the first plate and the second plate, wherein the first riser comprises a first lateral face including a plurality of assembly bolt receiving apertures and a second lateral face opposite the first lateral face and including a plurality of assembly bolt receiving apertures; and the second riser positioned between and abutting both the first plate and the second plate, wherein the first riser comprises a first lateral face including a plurality of assembly bolt receiving apertures and a second lateral face opposite the first lateral face and including a plurality of assembly bolt receiving apertures.

* * * * *